US009358669B2

(12) United States Patent
Rice et al.

(10) Patent No.: US 9,358,669 B2
(45) Date of Patent: Jun. 7, 2016

(54) HIGH ADHESION RESIN-MINERAL SYSTEMS

(71) Applicants: William C. Rice, Medway, MA (US); James J. Manning, Braintree, MA (US)

(72) Inventors: William C. Rice, Medway, MA (US); James J. Manning, Braintree, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 13/931,511

(22) Filed: Jun. 28, 2013

(65) Prior Publication Data

US 2014/0007514 A1 Jan. 9, 2014

Related U.S. Application Data

(60) Provisional application No. 61/666,762, filed on Jun. 29, 2012, provisional application No. 61/703,116, filed on Sep. 19, 2012.

(51) Int. Cl.
*B24D 3/28* (2006.01)
*B24D 11/00* (2006.01)

(52) U.S. Cl.
CPC . *B24D 3/28* (2013.01); *B24D 11/00* (2013.01)

(58) Field of Classification Search
CPC ..... C09G 1/02; C09K 3/14; B24D 3/00
See application file for complete search history.

(56) References Cited

U.S. PATENT DOCUMENTS

| | | | | |
|---|---|---|---|---|
| 4,018,574 | A | 4/1977 | Dyer | |
| 4,457,766 | A * | 7/1984 | Caul | 51/298 |
| 4,547,204 | A | 10/1985 | Caul | |
| 4,751,138 | A | 6/1988 | Tumey et al. | |
| 5,014,468 | A | 5/1991 | Ravipati et al. | |
| 5,089,584 | A * | 2/1992 | Nichols et al. | 528/58 |
| 5,256,170 | A | 10/1993 | Harmer et al. | |
| 5,304,224 | A * | 4/1994 | Harmon | 51/295 |
| 5,360,462 | A | 11/1994 | Harmer et al. | |
| 5,427,842 | A * | 6/1995 | Bland et al. | 428/213 |
| 5,436,063 | A | 7/1995 | Follett et al. | |
| 5,549,719 | A | 8/1996 | Lee et al. | |
| 5,730,764 | A | 3/1998 | Williamson et al. | |
| 5,766,277 | A | 6/1998 | DeVoe et al. | |
| 5,863,847 | A | 1/1999 | De Voe et al. | |
| 6,077,601 | A | 6/2000 | DeVoe et al. | |
| 6,406,576 | B1 | 6/2002 | Benedict et al. | |
| 7,294,158 | B2 | 11/2007 | Welygan et al. | |
| 2002/0090891 | A1 | 7/2002 | Adefris et al. | |
| 2004/0122203 | A1 * | 6/2004 | Van Den Berg et al. | 528/59 |
| 2006/0026904 | A1 | 2/2006 | Woo | |
| 2006/0148392 | A1 | 7/2006 | Ono et al. | |
| 2006/0183412 | A1 | 8/2006 | Allison et al. | |

OTHER PUBLICATIONS

PCT/US2013/048730, PCT International Search Report mailed Sep. 12, 2013, 1 page.

* cited by examiner

*Primary Examiner* — Pegah Parvini
*Assistant Examiner* — Alexandra M Moore
(74) *Attorney, Agent, or Firm* — Abel Law Group, LLP; Joseph P Sullivan

(57) ABSTRACT

A coated abrasive product that includes a polymer binder comprising a co-polyester having a bisphenol moiety in the backbone of the co-polyester. The coated abrasive product is capable of finishing coated surfaces and repairing defects in coated surfaces, including surfaces coated with automotive primers, paints, clear coats, and combinations thereof.

16 Claims, 4 Drawing Sheets

Roll 88 - SiC in 50/50 - New

HIGH ADHESION RESIN-MINERAL SYSTEMS

CROSS-REFERENCE TO RELATED APPLICATION

The present application claims priority from U.S. Provisional Patent Application Nos. 61/666,792, filed Jun. 29, 2012, entitled "High Adhesion Resin-Mineral Systems", naming inventors William C. Rice and James J. Manning, and 61/703,116, filed Sep. 19, 2012, entitled "High Adhesion Resin-Mineral Systems", naming inventors William C. Rice and James J. Manning, which applications are incorporated by reference herein in their entirety

BACKGROUND

1. Field of the Disclosure

The present disclosure is generally directed to high adhesion resin-mineral systems usable in abrasive products and methods related to the polishing and finishing of surfaces, including coated surfaces, using such abrasive products.

2. Description of the Related Art

Abrasive articles, such as fixed, coated and bonded abrasive articles, are used in various industries to abrade work pieces by hand or by machine processes, such as by lapping, grinding, or polishing. Machining utilizing abrasive articles spans a wide industrial and consumer scope from optics industries, automotive paint repair industries, and metal fabrication industries to construction and carpentry. Machining, whether using complex automated systems or by hand with commonly available tools, such as with orbital polishers (both random and fixed axis), and belt and vibratory sanders, is performed to remove surface material in an amount, and in a manner, that achieves desirable surface characteristics.

Surface characteristics can include, among others, shine, texture, gloss, surface roughness, and uniformity. In particular, surface characteristics, such as roughness, gloss, and lack of surface imperfections are measured to determine quality. For example, when coating or painting a surface certain imperfections or surface defects can occur during the coating application or coating curing process. Such surface imperfections or surface defects might include pock marks, "orange peel" texture, "fish eyes", encapsulated bubbles, and dust defects, a.k.a., "dust nibs." Typically, such defects in a painted surface are removed by first sanding with a coarse grain abrasive, followed by subsequently sanding with progressively finer grain abrasives, and even buffing with wool or foam pads until a desired smoothness is achieved. Hence, the properties of an abrasive article used will generally influence the surface quality.

In addition to surface characteristics, industries are sensitive to cost related to abrasive operations. Factors influencing operational costs include the speed at which a surface can be prepared and the cost of the materials used to prepare that surface. Typically, the industry seeks cost effective materials having high material removal rates.

However, abrasives that exhibit high removal rates often exhibit poor performance in achieving desirable surface characteristics. Conversely, abrasives that produce desirable surface characteristics often have low material removal rates. For this reason, preparation of a surface is often a multi-step process using various grades of abrasive sheets. Typically, surface flaws (e.g., scratches) introduced by one step are repaired (e.g., removed) using progressively finer grain abrasives in one or more subsequent steps. Therefore, abrasives that introduce scratches and surface flaws result in increased time, effort, and expenditure of materials in subsequent processing steps and an overall increase in total processing costs.

An additional factor affecting material removal rate and surface quality is the "loading" of the abrasive with "swarf", i.e., the material that is abraded from the workpiece surface, which tends to accumulate on the surface of, and between, the abrasive particles. Loading is undesirable because it typically reduces the effectiveness of the abrasive product and can also negatively affect surface characteristics by increasing the likelihood of scratching defects.

The surface characteristics and material removal rate can also be affected by the durability of the abrasive article. Abrasive articles that wear easily or lose grains can exhibit both a low material removal rate and can cause surface defects. Quick wear on the abrasive article can lead to a reduction in material removal rate, resulting in frequent exchanging of the abrasive article and increased waste associated with discarded abrasive articles.

There continues to be a demand for improved, cost effective, abrasive articles, processes, and systems that promote efficient abrasion and improved surface characteristics.

BRIEF DESCRIPTION OF THE DRAWINGS

The present disclosure can be better understood, and its numerous features and advantages made apparent to those skilled in the art by referencing the accompanying drawings.

The use of the same reference symbols in different drawings indicates similar or identical items.

DETAILED DESCRIPTION OF THE EMBODIMENT(S)

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The term "averaged," when referring to a value, is intended to mean an average, a geometric mean, or a median value.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Unless otherwise defined, all technical and scientific terms used herein have the same meaning as commonly understood by one of ordinary skill in the art to which this invention belongs. The materials, methods, and examples are illustrative only and not intended to be limiting.

Figure 1:
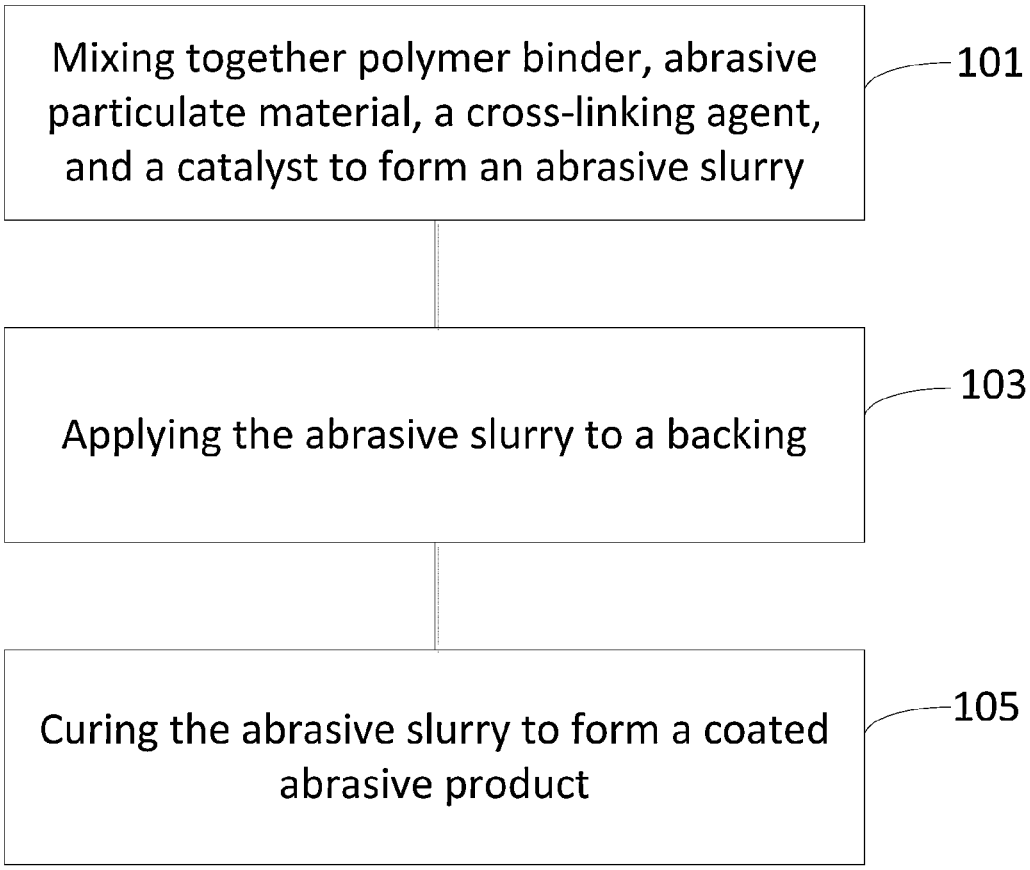
FIG. 1 is a process diagram of an embodiment of a method of forming an abrasive product.

FIG. 1 shows a particular embodiment of a method 100 of making a coated abrasive product. The process is initiated at activity 101 by mixing together polymer binder that comprises a co-polyester having a bisphenol moiety in the backbone of the co-polyester, abrasive particulate material, a cross-linking agent, and a catalyst to form an abrasive slurry. In activity 103, applying the abrasive slurry to a backing occurs. Curing of the abrasive slurry occurs in activity 105 to form a coated abrasive product.

Applicants have discovered that the polymeric binder compositions described herein provide surprisingly improved adhesion and retention of mineral abrasive grains within the binder. The improved grain retention and adhesion directly contribute to providing an improved overall durability of the coated abrasive, particularly the flexural durability of the abrasive layer, and also to providing superior abrasive performance.

Abrasive Particulate Material, Including Abrasive Particulate Material

In an embodiment, abrasive particulate material, such as abrasive grits, abrasive grains, abrasive agglomerates, abrasive aggregates, or combinations thereof, can be included in the polymer binder formulation. The abrasive particulate materials that are considered suitable for use in the present inventive embodiments are generally any mineral based abrasive particulate materials or mineral based abrasive compositions known in the art. Examples of suitable abrasive compositions can include non-metallic, inorganic solids such as carbides, oxides, nitrides and certain carbonaceous materials. Oxides include silicon oxide (such as quartz, cristobalite and glassy forms), cerium oxide, zirconium oxide, aluminum oxide. Carbides and nitrides include, but are not limited to, silicon carbide, aluminum, boron nitride (including cubic boron nitride), titanium carbide, titanium nitride, silicon nitride. Carbonaceous materials include diamond, which broadly includes synthetic diamond, diamond-like carbon, and related carbonaceous materials such as fullerite and aggregate diamond nanorods. Materials can also include a wide range of naturally occurring mined minerals, such as garnet, cristobalite, quartz, corundum, feldspar, by way of example. Certain embodiments of the present disclosure can take advantage of diamond, silicon carbide, aluminum oxide, and/or cerium oxide materials. In addition, those of skill will appreciate that various other compositions possessing the desired hardness characteristics can be used as abrasive grains suitable with the present inventive embodiments. In addition, in certain embodiments according to the present disclosure, mixtures of two or more different abrasive grains can be used in the same abrasive product. Moreover, in certain embodiments according to the present disclosure, the abrasive particles or grains can have specific contours that define particularly shaped abrasive particles.

According to an embodiment, abrasive particulate material are provided that are particularly suitable for machining operations, in which abrasion is carried out to remove material and improve surface quality. Abrasive particulate material can be formed through slurry-based processing. Embodiments can take advantage of spray drying, where a slurry containing the constituent materials of the aggregates and a liquid carrier, such as water, are mixed together, nebulized into droplets, and dried.

In an embodiment, suitable abrasive particulate material includes, for instance, the green, unfired abrasive aggregates described in, and produced according to the methods of U.S. Pat. No. 8,038,751 to Starling. The teachings of U.S. Pat. No. 8,038,751 to Starling that are related to the making of green, unfired abrasive aggregates are hereby incorporated by reference for all purposes. Suitable abrasive aggregates are also available from Saint-Gobain Abrasives, Inc. under the brand name Nanozyte® and are exemplary of green, unfired abrasive aggregates. According to certain embodiments, the abrasive product includes green unfired abrasive particulate material having a composite structure, including abrasive grits that have a size within the microparticle range, and a nanoparticle binder that provides the matrix of the abrasive aggregate in which the abrasive grits are embedded or contained.

Abrasive Coating Slurry and Preparation

In an embodiment, the abrasive particulate material is preferably combined with a polymeric resin material, or polymer binder mixture, that can be used to adhere the abrasive particulate material onto a surface of a backing. Processes for combining the abrasive particulate material with the polymer binder include slurry formation, in which the abrasive particulate material, polymer binder, and other additives are combined together until thoroughly mixed. In connection with slurry coating a backing, in addition to the abrasive particulate material, the slurry coating generally also includes a solvent such as water or an organic solvent. The abrasive slurry can additionally comprise other ingredients, such as organic solvents, thixotropic agents, dual function materials, crosslinking agents, surfactants, chain transfer agents, stabilizers, dispersants, curing agents, reaction mediators, pigments, dyes, colorants, and fillers. In an embodiment, the slurry can include polymer binder, abrasive particulate material, one or more organic solvents, one or more catalysts, and one or more crosslinking agents. In another embodiment, the abrasive slurry can, optionally, include a surfactant.

All the slurry ingredients are thoroughly mixed together using, for example, a high shear mixer. Mixing can be conducted using high shear conditions, moderate shear conditions, low shear conditions, or combinations thereof. Typically, mixing occurs until the ingredients are thoroughly mixed.

In an embodiment, polymer resin and surfactant are mixed together to form a base mixture under low shear to moderate shear conditions. Abrasive particulate material is then added to the base mixture under high shear conditions. To complete the formation of the abrasive slurry, a thixotrope can be added to the base mixture under low shear conditions followed by the addition of a cross-linker, also under low shear conditions.

In an embodiment, the abrasive slurry has a composition that can include between about 10 wt % to about 20 wt % polymer resin, between about 25 wt % to about 50 wt % abrasive particulate material between about 0.2 wt % to about 1.0 wt % crosslinking agent, between about 0.01 wt % to about 0.04 wt % catalyst agent with the remainder organic solvent, where the percentages are based on total weight of the abrasive slurry. Optionally, between about 0.1 wt % to about 0.5 wt % of a surfactant can also be added to the abrasive slurry. If the surfactant is included, the amount of organic solvent can be adjusted so that the total amounts add up to 100 wt %.

The viscosity of the abrasive slurry can be monitored as it is being prepared. In an embodiment, the viscosity of the abrasive slurry is in a range of about 50 cps to about 200 cps prior to addition of the thixotropic agent and the crosslinking agent. After the addition of the thixotropic agent and the crosslinking agent, the abrasive slurry can have a viscosity in the range of about 210 to about 450 cps.

During mixing of the abrasive slurry ingredients, the ingredients can be added to the slurry one by one, in batches, or all at once. Typically the ingredients are added one by one to the abrasive slurry. If the ingredients are added one by one or in batches, the slurry can be agitated for a period of time until the ingredient has sufficiently mixed into the slurry. Typical agitation times range from about 1 minute to about 2 hours, depending on the ingredient or ingredients being added to the abrasive slurry.

In an embodiment, the abrasive slurry will have a ratio of green, unfired abrasive aggregate to polymer binder in the range from about 2:1 to about 3:1, about 2.25:1 to about 2.75:1, or about 2.5:1. In another embodiment, the abrasive slurry will have a ratio of polymer binder to crosslinking agent ranging from about 5:1 to about 45:1, or from about 9:1 to about 40:1.

Suitable Polymer Resins

Suitable polymer binder materials include polyesters, epoxy resins, polyurethanes, polyamides, polyacrylates, polymethacrylates, poly vinyl chlorides, polyethylene, polysiloxane, silicones, cellulose acetates, nitrocellulose, natural rubber, starch, shellac, and mixtures thereof. A polymer binder mixture can include more than one kind of a polymer resin from a class of polymer resins; for example, a polyester resin can be a mixture of copolyester resins.

In an embodiment, a polymer binder comprises a co-polyester having a bisphenol moiety in the backbone of the co-polyester. The co-polyester can comprise less than 50 wt % of the polymer binder, about 50 wt % of the polymer binder, or greater than 50 wt % of the polymer binder.

In an embodiment, the polymer binder comprises a single copolyester resin, multiple copolyester resins, or mixtures thereof that have a bisphenol moiety in the backbone of the copolyester resin or resins. In a particular embodiment, the copolyester is single copolyester resin having a bisphenol moiety in the backbone of the copolyester resin. In another particular embodiment, the copolyester is a mixture of two different copolyester resins, one of which has a bisphenol moiety in the backbone of the copolyester resin. In another embodiment, the co-polyester comprises a plurality of co-polyesters that each have a bisphenol moiety in their backbones.

In an embodiment, the bisphenol moiety in the backbone of the co-polyester can be one of the group consisting of: Bisphenol-A (2,2-Bis(4-hydroxyphenyl)propane), Bisphenol AP (1,1-Bis(4-hydroxyphenyl)-1-phenyl-ethane), Bisphenol-AF (2,2-Bis(4-hydroxyphenyl)hexafluoropropane), Bisphenol-B (2,2-Bis(4-hydroxyphenyl)butane), Bisphenol-BP (Bis-(4-hydroxyphenyl)diphenylmethane), Bisphenol-C (2,2-Bis(3-methyl-4-hydroxyphenyl)propane), Bisphenol-E (1,1-Bis(4-hydroxyphenyl)ethane), Bisphenol-F (Bis(4-hydroxydiphenyl)methane), Bisphenol-G (2,2-Bis(4-hydroxy-3-isopropyl-phenyl)propane), Bisphenol-M (1,3-Bis(2-(4-hydroxyphenyl)-2-propyl)benzene), Bisphenol-S (Bis(4-hydroxyphenyl)sulfone), Bisphenol-P (1,4-Bis(2-(4-hydroxyphenyl)-2-propyl)benzene), Bisphenol-PH (5,5'-(1-Methylethyliden)-bis[1,1'-(bisphenyl)-2-ol]propane), Bisphenol-TMC (1,1-Bis(4-hydroyphenyl)-3,3,5-trimethyl-cyclohexane), Bisphenol-Z (1,1-Bis(4-hydroxyphenyl)-cyclohexane), and any combinations thereof.

The amount of bisphenol moiety in the backbone of the co-polyester can vary. The amount of bisphenol moiety is at least 3 wt % to not greater than 75 wt % of the co-polyester backbone.

In an embodiment, the polymer binder can further comprise a polymeric moiety that is cross-linked into the polymeric binder. The polymeric moiety that can be cross-linked into the polymer binder can be: a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novo lac polymer; phenolic/latex polymer; epoxy polymer such as bisphenol epoxy polymer; iso cyanate; isocyanurate; polysiloxane polymer including alkylalkoxysilane polymer; or reactive vinyl polymer. The moiety that is cross-linked into the polymer binder can include a monomer, an oligomer, a polymer, or a combination thereof. The moiety that is cross-linked into the polymer binder can include a polymer system, such as an ultraviolet light (UV) cured polymer system. In an embodiment, the polymer binder can further comprise a polymeric moiety that is cross-linked into the polymeric binder, wherein the polymeric moiety is selected from the group consisting of: bisphenol-A; an epoxy; a phenol formaldehyde; a blocked isocyanate; a urea formaldehyde; a novolac; a resole; a resorcinol-formaldehyde; a UV curable hybrid acrylic epoxy composition; and any combinations thereof.

The polymeric moiety that is cross-linked into the polymeric binder can comprise about 0.5 wt % to about 50 wt % of the total weight of the polymeric binder.

The amount of bisphenol moiety in the polymer binder can vary. The amount of bisphenol moiety is at least 3 wt % to not greater than 75 wt % of the polymer binder.

In an embodiment, the total amount of polymer binder in the abrasive slurry can be at least about 10 wt %, at least about 12 wt %, at least about 13 wt %, at least about 14 wt %, or at least about 15 wt %. In another embodiment, the amount of polymer binder in the abrasive slurry can be not greater than about 20 wt %, not greater than about 19 wt %, not greater than about 18 wt %, or not greater than about 17 wt %. The amount of polymer binder in the abrasive slurry can be within a range comprising any pair of the previous upper and lower limits. In a particular embodiment, the amount of polymer binder included in the abrasive slurry can be in the range of at least about 10 wt % to not greater than about 20 wt %.

Polyester Resin

Suitable polyester resins include linear, saturated copolyester resins that can be amorphous and highly-soluble in standard solvents, such as methyl ethyl ketone (2-butanone) (MEK), Toluol, ethyl acetate, and acetone. Alternatively, other suitable polyester resins can be semi-crystalline to crystalline products that have limited solubility and are applied with solvents such as 1,3 Dioxolane or tetrahydrofuran (THF). In an embodiment the polyester resin can be a thermoplastic, high molecular weight, aromatic, linear saturated copolyester resin. For example, Vitel 2210 (Rohm and Haas Company, a wholly owned division of Dow Chemical, Philadelphia, Pa., USA), Skybon ES-120 (SK Chemicals, South Korea or Worthen Industries, Nashua, N.H., USA), or Skybon ES-995 (SK Chemicals, South Korea or Worthen Industries, Nashua, N.H., USA). In an embodiment, the total amount of polyester resin in the abrasive slurry can be at least about 5.0 wt %, at least about 8.0 wt %, or at least about 10 wt %. In another embodiment, the amount of polyester resin in the abrasive slurry can be not greater than about 20 wt %, not greater than about 19 wt %, not greater than about 18 wt %, or not greater than about 17 wt %. The amount of polyester resin in the abrasive slurry can be within a range comprising any pair of the previous upper and lower limits. In a particular embodiment, the amount of polyester resin included in the abrasive slurry can be in the range of at least about 10 wt % to not greater than about 20 wt %, or at least about 10 wt % to not greater than about 18 wt %, or at least about 12 wt % to not greater than about 17 wt %.

In an embodiment, the polymer binder is one of the group consisting of a polyester resin, a copolyester resin, a mixture of more than one copolyester resin, and combinations thereof. In another embodiment, the polymer binder is a single copolyester resin. In a particular embodiment, the polymer binder is a mixture of two different copolyester resins (i.e., a first copolyester resin and a second copolyester resin). In another embodiment, the first copolyester resin is a hard resin and the second copolyester resin is a soft resin. In another embodiment, the ratio of the first copolyester resin to the second copolyester resin is about 9:1 to about 0.25:1. In a particular embodiment, the ratio of the hard copolyester resin to the soft copolyester resin is about 1:1.

The polymer binders can be solvent borne copolyester resins. In an embodiment, a first copolyester resin, such as hard resin, has an intrinsic viscosity of at least 0.50 dl/g, a glass transition temperature (Tg) of at least 65° C. (such as by DSC), a number average molecular weight (Mn) of at least 15,000, and an OH value from 2-6 KOH mg/g, and a softening point of at least 130° C. In another embodiment, a second copolyester resin, such as a soft resin, has an intrinsic viscosity of at least 0.38 dl/g, a glass transition temperature (Tg) of at least 55° C., a number average molecular weight (Mn) of at least 11,000, and an OH value from 4-15 KOH mg/g, and a softening point of at least 120° C. In a particular embodiment, the first copolyester resin has an intrinsic viscosity of 0.53 dl/s, a glass transition temperature (Tg) of 65° C., a number average molecular weight (Mn) of 18,000, an OH value from 2-6 KOH mg/g, and a softening point of 135° C. In a particular embodiment, the second copolyester resin has an intrinsic viscosity of at least 0.62 dl/s, a glass transition temperature (Tg) of at least 67° C., a number average molecular weight (Mn) of at least 20,000, and an OH value from 4-8 KOH mg/g, and a softening point of at least 140° C. In another particular embodiment, the second copolyester resin has an intrinsic viscosity of at least 0.38 dl/s, a glass transition temperature (Tg) of at least 55° C., a number average molecular weight (Mn) of at least 11,000, and an OH value from 9-15 KOH mg/g, and a softening point of at least 120° C. In another particular embodiment, the first copolyester resin, or hard copolyester resin, is Skybon ES-120. In another particular embodiment, the second copolyester resin, or soft copolyester resin, is Skybon ES-901 or Skybon ES-955.

Polymer binders of the abrasive slurry can be partially dissolved with solvent (i.e., "diluted") to be more workable and have a particular percent solids range, or viscosity, depending on the application. In an embodiment, the polymer binder of the abrasive slurry can have a percent solids between about 35 wt % and about 80 wt % based the combined polymer binder and solvent. In another embodiment, the polyester resin can be diluted with organic solvent to have a solids content in the range of about 20 wt % to about 50 wt %. In another embodiment, the epoxy resin can be diluted with organic solvent to have a solids content in the range of about 40 wt % to about 80 wt %.

As previously discussed, suitable abrasive particulate material can be the abrasive particulate material described in and produced according to the methods of U.S. Pat. No. 8,038,751 to Starling. Preferred are abrasive particulate material available from Saint-Gobain Abrasives, Inc. under the brand name Nanozyte®. In a particularly embodiment, abrasive particulate material contain silicon carbide abrasive grit. In an embodiment, the amount of abrasive aggregate in the abrasive slurry can be at least about 25 wt %, at least about 26 wt %, at least about 27 wt %, or at least about 28 wt %. In another embodiment, the amount of abrasive aggregate in the abrasive slurry can be not greater than about 50 wt %, not greater than about 48 wt %, not greater than about 46 wt %, or not greater than about 45 wt %. The amount of abrasive aggregate in the abrasive slurry can be within a range comprising any pair of the previous upper and lower limits. In a particular embodiment, the amount of abrasive aggregate included in the abrasive slurry can be in the range of at least about 25 wt % to not greater than about 50 wt %.

Suitable organic solvents are those which dissolve the resins of abrasive slurry, such as, for example, ketones, ethers, polar aprotic solvents, esters, aromatic solvents and aliphatic hydrocarbons, both linear and cyclic. Exemplary ketones include methyl ethyl ketone (2-butanone) (MEK), acetone and the like. Exemplary ethers include alkoxyalkyl ethers, such as methoxy methyl ether or ethyl ether, tetrahydrofuran, 1,4 dioxane and the like. Polar aprotic solvents include dimethyl formamide, dimethyl sulfoxide and the like. Suitable esters include alkyl acetates, such as ethyl acetate, methyl 65 acetate and the like. Aromatic solvents include alkylaryl solvents, such as toluene, xylene and the like and halogenated aromatics such as chlorobenzene and the like. Hydrocarbon type solvents include, for example, hexane, cyclohexane and the like. A preferred organic solvent is methyl ethyl ketone. In an embodiment, the amount of organic solvent in the abrasive slurry can be at least about 5.0 wt %, at least about 6.0 wt %, at least about 7.0 wt %, or at least about 8.0 wt %. In another embodiment, the amount of organic solvent in the abrasive slurry can be not greater than about 68 wt %, not greater than about 67 wt %, not greater than about 66 wt %, not greater than about 65 wt %, or not greater than about 64 wt %. The amount of organic solvent in the abrasive slurry can be within a range comprising any pair of the previous upper and lower limits. In a particular embodiment, the amount of organic solvent included in the abrasive slurry can be in the range of at least about 5.0 wt % to not greater than about 68 wt %.

Suitable surfactants are those that have a low solubility in water and that have amphipathic properties. In an embodiment, lecithin is a surfactant. In an embodiment, the amount of surfactant in the abrasive slurry can be at least about 0.1 wt %, at least about 0.125 wt %, or at least about 0.15 wt %. In another embodiment, the amount of surfactant in the abrasive slurry can be not greater than about 0.5 wt %, not greater than about 0.4 wt %, not greater than about 0.375 wt %, or not greater than about 0.35 wt %. The amount of surfactant in the abrasive slurry can be within a range comprising any pair of the previous upper and lower limits. In a particular embodiment, the amount of surfactant included in the abrasive slurry can be in the range of at least about 0.1 wt % to not greater than about 0.5 wt %.

Suitable catalyst agents (i.e., catalysts) are materials that promote polymeric reactions. In an embodiment, the catalyst can be an amine neutralized mixture of sulfonic acids. In another embodiment, the catalyst can be a tetravalent diorganotin. More than one type of catalyst or mixtures of catalyst can be used in the abrasive slurry mixture. In an embodiment, the amount of catalyst in the abrasive slurry can be at least about 0.01 wt %, at least about 0.015 wt %, or at least about 0.0175 wt %. In another embodiment, the amount of catalyst in the abrasive slurry can be not greater than about 0.04 wt %, not greater than about 0.0375 wt %, not greater than about 0.035 wt %, or not greater than about 0.0325 wt %. The amount of catalyst in the abrasive slurry can be within a range comprising any pair of the previous upper and lower limits. In a particular embodiment, the amount of catalyst included in the abrasive slurry can be in the range of at least about 0.01 wt % to not greater than about 0.04 wt %.

Suitable cross-linking agents are those that promote crosslinking of the polymer binder materials in the abrasive slurry. Preferred, the crosslinking agent promotes crosslinking of polyester resin, or epoxy resin, or combinations thereof. It should be recognized that the crosslinking agents of the abrasive slurry are not necessarily related to the crosslinking agents of the abrasive aggregate. In an embodiment, cross-linking agents can be isocyanates, including polyisocyanates. In another embodiment, crosslinking agents can be a methylated melamine. In an embodiment, the amount of cross-linking agent in the abrasive slurry can be at least about 0.2 wt %, at least about 0.3 wt %, or at least about 0.4 wt %. In another embodiment, the amount of cross-linking agent in the abrasive slurry can be not greater than about 1.0 wt %, not greater than about 0.8 wt %, or not greater than about 0.7 wt %. The amount of cross-linking agent in the abrasive slurry can be within a range comprising any pair of the previous upper and lower limits. In a particular embodiment, the amount of cross-linking agent included in the abrasive slurry can be in the range of at least about 0.1 wt % to not greater than about 1.0 wt %.

Applying the Abrasive Slurry to Backing

The abrasive slurry containing the abrasive aggregate grains is preferably applied to the backing using a blade spreader to form a coating. Alternatively, the slurry coating can be applied using slot die, smooth rolling, gravure, or reverse gravure coating methods. The coating thickness can range from about 1 to about 5 mils in thickness, after drying. As the backing is fed under the blade spreader at a desired coating speed, the abrasive slurry is applied to the backing in the desired thickness. The coat speed is preferably between about 10 to about 40 feet per minute.

Figure 2:
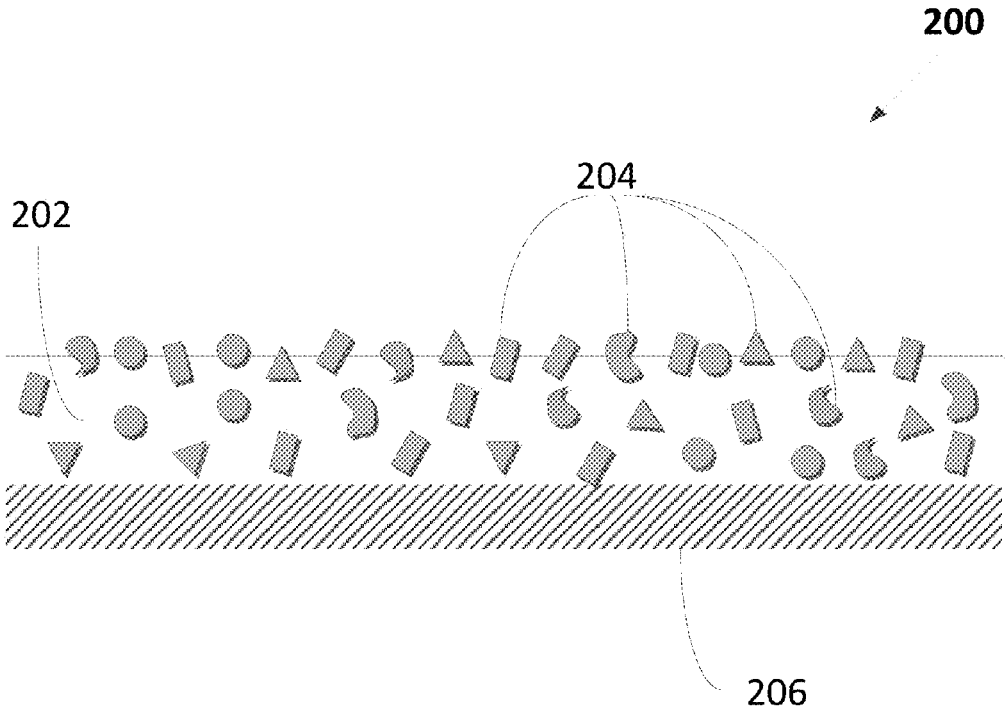
FIG. 2 is an illustration of a cross-sectional view of a coated abrasive that includes an abrasive layer comprising a copolyester.
Figure 3:
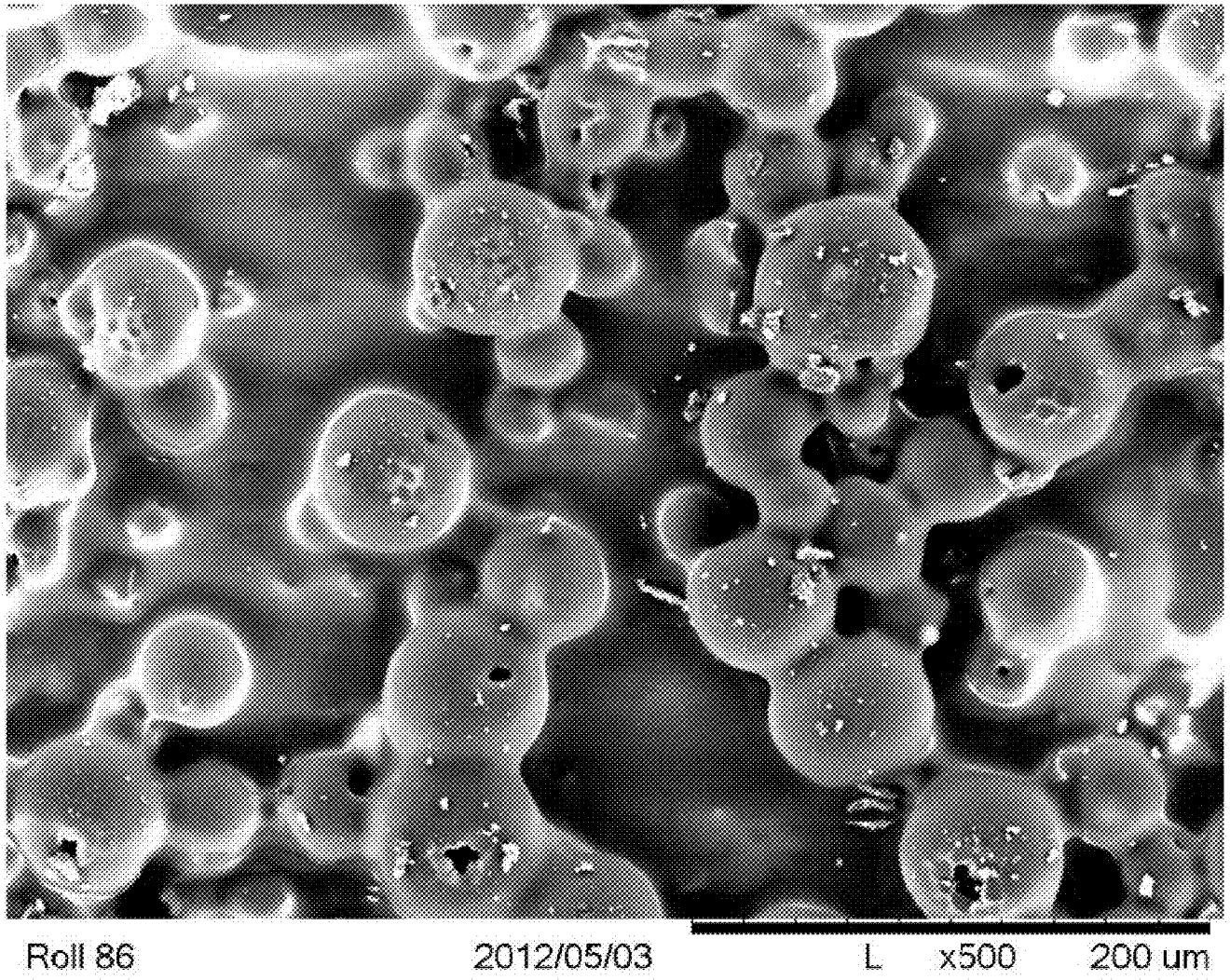
FIG. 3 is a micrograph of an illustrative embodiment
Figure 4:
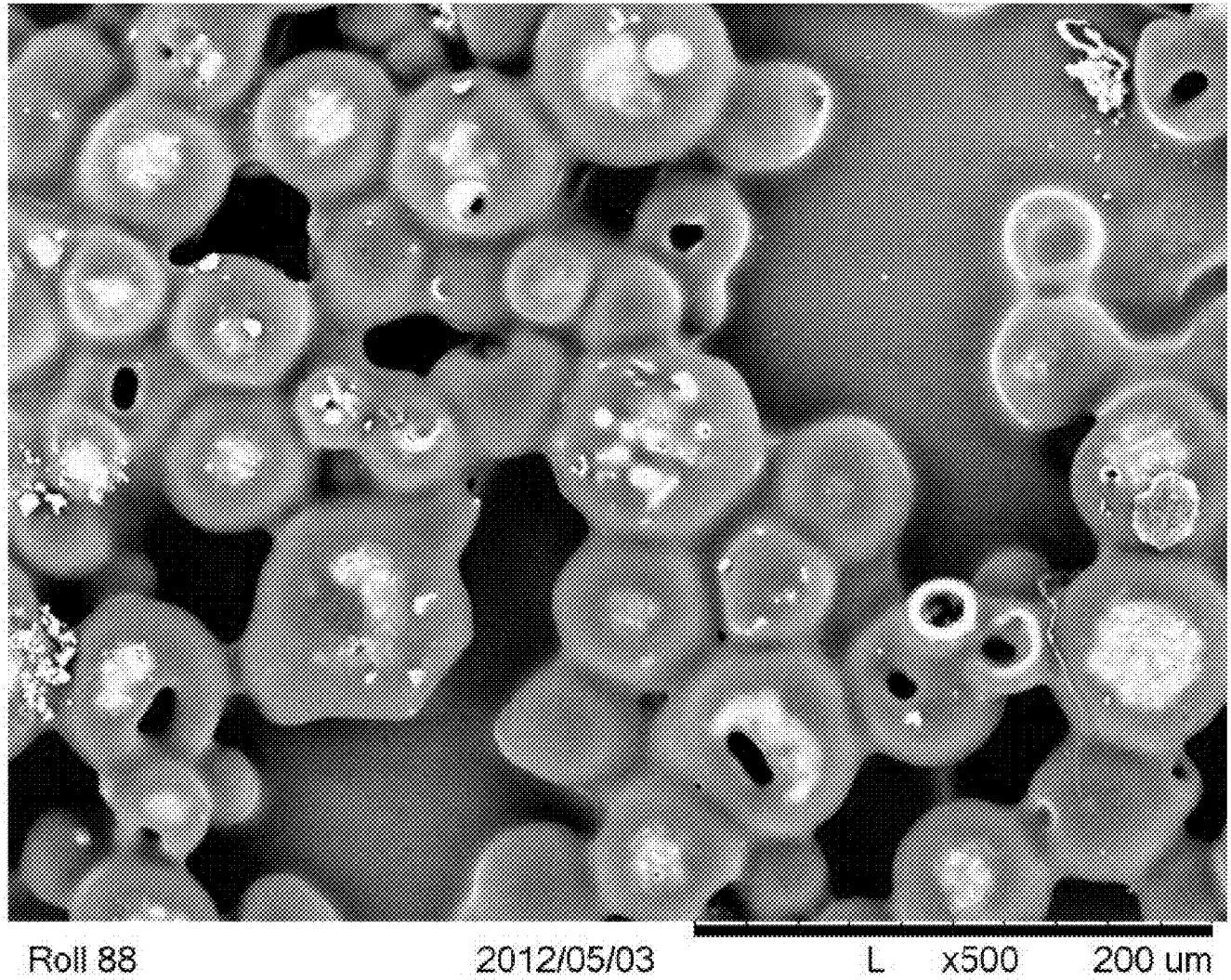
FIG. 4 is a micrograph of an illustrative embodiment

In an alternate embodiment, a resin mixture is first coated onto the backing, and the abrasive particulate material are placed onto the resin coated backing through electrostatic attraction (sometimes called "upcoating") or simply down through gravity (e.g., sprinkled onto the backing). Both approaches are well understood in the art, generally first depositing a 'make coat' on the backing, followed by abrasive aggregate application onto the make coat, and subsequent deposition of a 'size coat.' Optionally, a supersize coat can be deposited over the size coat. Further, a pliant coat can be disposed between the make coat and the backing. In another embodiment, a back coat can be disposed over the backing on a side opposite the make coat. FIG. 2 shows an embodiment of an abrasive product 200 comprising abrasive particulate material 204 dispersed in a resin composition 202 (which together are an abrasive slurry layer) that is disposed on a backing 206.

Curing the Abrasive Slurry

The coated backing is then heated in order to cure the resin and bond the abrasive aggregate grains to the backing. The resin can be at least partially cured or fully cured. Additional molding or forming of the partially cured coating can be performed prior to full curing. In general, the coated backing is heated to a temperature of between about 100° C. to less than about 250° C. during the curing process. In certain embodiments of the present disclosure, it is preferred that the curing step be carried at a temperature of less than about 200° C.

Once the resin is fully cured, the abrasive particulate material are bonded to the backing and the coated backing can be used for a variety of stock removal, finishing, and polishing applications.

In an embodiment the cured abrasive coating has a composition that can include between about 20 wt % to about 40 wt % polymer resin, between about 85 wt % to about 50 wt % abrasive particulate material between about 0.4 wt % to about 2.0 wt % crosslinking agent, and between about 0.1 wt % to about 0.04 wt % catalyst, wherein the percentages are based on total weight of the cured abrasive coating. Optionally, between about 0.5 wt % to about 3.0 wt of a surfactant can also be included in the cured abrasive coating. If the surfactant is included, the amount of abrasive aggregate can be adjusted so that the total amounts add up to 100 wt %.

In an embodiment, the total amount of polymer binder in the cured abrasive coating can be at least about 20 wt %, at least about 21 wt %, at least about 22 wt %, at least about 23 wt %, or at least about 24 wt %. In another embodiment, the amount of polymer binder in the cured abrasive coating can be not greater than about 40 wt %, not greater than about 38 wt %, not greater than about 36 wt %, not greater than about 34 wt %, or not greater than about 32 wt %. The amount of polymer binder in the cured abrasive coating can be within a range comprising any pair of the previous upper and lower limits. In a particular embodiment, the amount of polymer binder included in the cured abrasive coating can be in the range of at least about 20 wt % to not greater than about 40 wt %, at least about 22 wt % to not greater than about 38 wt %, or at least about 24 wt % to not greater than about 36 wt %.

In an embodiment, the amount of polyester resin in the cured abrasive coating can be at least about 20 wt %, at least about 21 wt %, at least about 22 wt %, at least about 23 wt %, or at least about 24 wt %. In another embodiment, the amount of polyester resin in the cured abrasive coating can be not greater than about 40 wt %, not greater than about 38 wt %, not greater than about 36 wt %, not greater than about 34 wt %, or not greater than about 32 wt %. The amount of polyester resin in the cured abrasive coating can be within a range comprising any pair of the previous upper and lower limits. In a particular embodiment, the amount of polyester resin included in the cured abrasive coating can be in the range of at least about 20 wt % to not greater than about 40 wt %, at least about 22 wt % to not greater than about 38 wt %, or at least about 24 wt % to not greater than about 36 wt %.

In an embodiment, the amount of abrasive aggregate in the cured abrasive coating can be at least about 50 wt %, at least about 52 wt %, at least about 54 wt %, at least about 56 wt %, or at least about 58 wt %. In another embodiment, the amount of abrasive aggregate resin in the cured abrasive coating can be not greater than about 85 wt %, not greater than about 83 wt %, not greater than about 80 wt %, not greater than about 77 wt %, or not greater than about 75 wt %. The amount of abrasive aggregate resin in the cured abrasive coating can be within a range comprising any pair of the previous upper and lower limits. In a particular embodiment, the amount of abrasive aggregate resin included in the cured abrasive coating can be in the range of at least about 50 wt % to not greater than about 85 wt %, at least about 52 wt % to not greater than about 83 wt %, at least about 54 wt % to not greater than about 80 wt %, at least about 56 wt % to not greater than about 78 wt %, at least about 58 wt % to not greater than about 77 wt %.

In an embodiment, the amount of catalyst in the cured abrasive coating can be at least about 0.01 wt %, at least about 0.0125 wt %, at least about 0.015 wt %, or at least about 0.0175 wt %. In another embodiment, the amount of catalyst resin in the cured abrasive coating can be not greater than about 0.04 wt %, not greater than about 0.0375 wt %, not greater than about 0.035 wt %, or not greater than about 0.035 wt. The amount of catalyst in the cured abrasive coating can be within a range comprising any pair of the previous upper and lower limits. In a particular embodiment, the amount of catalyst included in the cured abrasive coating can be in the range of at least about 0.01 wt % to not greater than about 0.04 wt %.

In an embodiment, the amount of cross-linking agent in the cured abrasive coating can be at least about 0.4 wt %, at least about 0.5 wt %, at least about 0.6 wt %, at least about 0.7 wt %, or at least about 0.8 wt %. In another embodiment, the amount of cross-linking agent resin in the cured abrasive coating can be not greater than about 2.0 wt %, not greater than about 1.9 wt %, not greater than about 1.8 wt %, not greater than about 1.7 wt %, or not greater than about 1.6 wt %. The amount of cross-linking agent resin in the cured abrasive coating can be within a range comprising any pair of the previous upper and lower limits. In a particular embodiment, the amount of cross-linking agent resin included in the cured abrasive coating can be in the range of at least about 0.4 wt % to not greater than about 2.0 wt %.

Backing

The cured abrasive coated backing can them be used as a lapping film or a micro-finishing film for finishing and/or polishing other materials. Backing materials which can be coated in this manner include, but are not limited to, any flexible web, including polymeric film, paper, cloth, metallic film, vulcanized fiber, non-woven substrates, and any combinations of the foregoing, and treated versions of the foregoing materials. The backing preferably comprises a polymeric film, such as a film of polyester, polyurethane, polypropylene, polyimides such as KAPTON from DuPont. Polyester films are particularly preferred as the backing material in certain embodiments of the present disclosure. The film preferably can be primed to promote adhesion of the abrasive particulate material to the backing. Suitable backings can have a thickness, before being coated, of from about 1 to about 14 mils. The backing can be laminated to another substrate for strength, support, or dimensional stability. Lamination can be accomplished before or after the abrasive article is formed. The abrasive article can be in the form of an endless belt, a disk, a sheet, or a flexible tape that is sized so as to be capable of being brought into contact with a workpiece. The abrasive particulate material can be disposed on one or both major surfaces of the backing.

Repair of Automotive Coatings on Surfaces

The abrasive product can be used for stock removal, finishing, and polishing of surfaces coated with primers, paints, clearcoats, and combinations thereof. In a particular embodiment, the abrasive product can be used for stock removal, finishing, and polishing of surfaces coated with automotive primers, automotive paints, automotive clearcoats, and combinations thereof.

When used for polishing or repair of coated surfaces, the abrasive products are preferably produced including abrasive particulate material formed from silicon carbide grit combined with a silica nanoparticle binder. The grit particles preferably have a size of in the range of about 6 micrometers to about 12 micrometers, with an average size of about 9 micrometers. The overall size of the abrasive particulate material is preferably from about 30 micrometers to about 90 micrometers. These abrasive particulate material are preferably bonded to polyester polymeric film backing. Using the abrasive product, polishing of the surfaces can be carried out, for example, using metal polishing machines such as those available from Struers, Inc. of Westlake, Ohio), Grinding Equipment & Machinery Company, LLC. ("GEM") (Youngstown, Ohio, USA), Loeser-USA Inc. (Brighton, Mich., USA), Supfina Machine Company, Inc. (North Kingstown, R.I., USA), and Dynabrade Inc. (Clarence, N.Y., USA).

Such metal polishing machines are known in the art and typically take advantage of embodiments of the abrasive product in the form of sheets, discs, endless belts, tapes, or polymeric films.

State-of-art conventional finishing processes are typically accomplished by a multi-step, incremental process. The surface is first polished with a relatively coarse abrasive material and then polished again with a somewhat finer grit abrasive material. This process is usually repeated several times, with each successive polishing being carried out with a progressively finer grit abrasive until the surface is polished to the desired degree of smoothness. This type of multi-step polishing procedure can conventionally consume extensive amounts of time and extensive amounts of abrasive products.

It has been quite surprisingly and unexpectedly observed that an increased durability and abrasive grain retention is achieved and a corresponding superior abrasive performance demonstrated when abrasive products according to the present disclosure are used. The higher durability results in a considerable reduction in the amount of abrasive product consumed to achieve a desired degree of polishing smoothness, as well as marked reduction in costs due to time saved by not having to switch out successive different abrasive products.

Various surface roughness parameters are known in the art and used to describe the surface quality. The arithmetical mean ("average") roughness, or Ra, of a surface is a measure of the degree of variations in the overall height profile of a surface over a given standard length. Root mean square roughness, Rq, also called Rrms, is a measure of the root mean square of the roughness over a given standard length. Maximum peak, or maximum height, Ry, measures the maximum distance between the highest peak and the lowest valley along a standard length. Ten-point mean roughness, Rz, is a measure of the average of the five highest peaks and the five lowest valleys. Lower Ra, Rq, Ry, and Rz values are generally indicative of a surface that is smoother and has smaller variations in its overall height between differing locations on the surface (i.e., it has a generally smoother surface profile).

Alternatively, there are many surface quality parameters that are subjective and depend upon the observations of experienced human operators for quality assessment. For example, visual assessment, touch, and even sound can be used to judge surface quality during an abrasion process.

The properties and advantage of the present disclosure are illustrated in further detail in the following nonlimiting examples. Unless otherwise indicated, temperatures are expressed in degrees Celsius, pressure is ambient, and concentrations are expressed in weight percentages.

Components Listing

Skybon ES 120 (diluted—42% solids in MEK)—thermoplastic, high molecular weight, solvent borne copolyester resin that does not include any bisphenol moieties in the backbone of the resin(SK Chemicals Company, Korea or SK USA, Inc, Fort Lee, N.J.).

Skybon ES 901 (diluted—42% solids in Toluene—thermoplastic, high molecular weight, copolyester resin that includes approximately 23-28 wt % bisphenol A in the backbone of the resin (SK Chemicals Company, Korea or SK USA, Inc, Fort Lee, N.J.).

Skybon ES 955 (diluted—42% solids in Toluene—thermoplastic, high molecular weight, copolyester resin that includes approximately 30-35 wt % bisphenol A in the backbone of the resin (SK Chemicals Company, Korea or SK USA, Inc, Fort Lee, N.J.).

Methyl Ethyl Ketone (MEK)—commonly commercially available, reagent grade.

Toluene—commonly commercially available, reagent grade.

Yelkins TS—Soya lecithin (Archer Daniels Midland Company, Decatur, Ill., USA).

BYK-410—thixotropic agent solution of modified urea (BYK USA Inc., Wallingford, Conn.).

NGC-2500—green silicon carbide abrasive grit, average particle size 8 microns (Nanko Abrasives, Inc., Tokyo, Japan)

Abrasive Aggregate—green, unfired abrasive particulate material comprising diamond or green silicon carbide grit having an average size conforming to about 6 to 12 micron or 9 to 15 micron (for diamond) or J2500 (for SiC) that are dispersed in nanoparticle colloidal silica (Saint-Gobain Abrasives, Inc., Worcester, Mass.).

Cymel 301—Highly methylated melamine crosslinker (Cytec Industries, Inc., Woodland Park, N.J.).

Nacure XC-9211—amine neutralized catalyst, based on a mixture of sulfonic acids (King Industries, Inc., Norwalk, Conn.).

Example 1

1A. Abrasive Slurry Preparation

Abrasive slurry compositions were made by mixing together the following components listed in the table below.

TABLE 1

Abrasive Slurry Compositions

| Component | Abrasive Slurry 1 Wt % | Abrasive Slurry 2 Wt % | Abrasive Slurry 3 Wt % |
|---|---|---|---|
| Skybon ES-120 @ 42% in MEK | 13.5 | 0 | 6.75 |
| Skybon ES-955 @ 42% in MEK | 0 | 13.5 | 6.75 |
| Organic Solvent (Toluene) | 52.18 | 52.18 | 52.18 |
| Yelkins TS | 0.3 | 0.3 | 0.3 |
| Abrasive Aggregate [NGC-2500 | 33 | 33 | 33 |
| BYK-410 | 0.3 | 0.3 | 0.3 |
| Cymel 301 | 0.7 | 0.7 | 0.7 |
| Nacure XC-9211 | 0.02 | 0.02 | 0.02 |
| Total | 100.0 | 100.0 | 100.0 |

For each composition, diluted Skybon ES-120 (42% solids), Skybon ES-955 (42% solids), an organic solvent, Yelkins TS, the abrasive aggregate, crosslinker, and catalyst were mixed together in a high shear mixer until thoroughly mixed. The diluted polymer resin and Yelkins TS were first mixed together under moderate shear conditions. The resulting mixture was then agitated under high shear and the abrasive aggregate was added until thoroughly mixed in. The resulting mixture was then agitated under low shear and the BYK-410, Cymel 301, and Nacure XC-9211 were mixed in. The resulting abrasive slurry mixture was allowed to stand for approximately 45 minutes and then agitated lightly. The abrasive slurry compositions had a viscosity in the range of about 200 to 400 cps.

1B. Abrasive Film Preparation

Each of the Abrasive Slurry Compositions 1-3, prepared as above in 1.A., were applied to 3 mil polyethylene terephthalate (PET) polymeric film to form an abrasive slurry coated product. Each of the abrasive slurry coated films was cured by oven at a temperature in the range of about 150° C. to 205° C. Upon exiting the oven, the abrasive slurry compositions were cured, thus forming cured abrasive layers, and were substantially complete, wherein the abrasive particulate material were substantially bonded to the film backings.

1C. Cured Abrasive Composition (Cured Abrasive Layer)

The components of the cured abrasive layers are listed in the table below.

TABLE 2

Cured Abrasive Compositions (Cured Abrasive Layers)

| Component | Cured Abrasive Layer 1 Wt % | Cured Abrasive Layer 2 Wt % | Cured Abrasive Layer 3 Wt % |
|---|---|---|---|
| Skybon ES-120 | 14.18 | 0 | 7.09 |
| Skybon ES-955 | 0 | 14.18 | 7.09 |
| Yelkins TS | 0.75 | 0.75 | 0.75 |
| Abrasive Aggregate | 82.52 | 82.52 | 82.52 |
| BYK-410 | 0.75 | 0.75 | 0.75 |
| Cymel 301 | 1.75 | 1.75 | 1.75 |
| Nacure XC-9211 | 0.05 | 0.05 | 0.05 |
| Total | 100.0 | 100.0 | 100.0 |

The completed abrasive films were selected for flex testing and abrasive performance testing.

Example 2

Flex Testing of Abrasive Films

Each of the produced coated abrasives (abrasive films) was flex tested to determine relative adhesion strength of the cured abrasive layer to the backing film material. Each coated abrasive was flexed back and forth to a 180 degree angle (i.e., folded in half back and forth). Each flex cycle consisted of one flex back 180 degrees and one flex forth 180 degrees. Flexing was performed until failure of the abrasive film. The number of completes flex cycles prior to failure was recorded as shown in the table below. Failure occurred when the cured binder (i.e., the cured polymer resin of the abrasive layer) broke off of the backing film at the flex line.

TABLE 3

Flex Testing Results

| Sample | Polymerized Bisphenol Content (in Polymer Backbone) as % of Total Binder Resin; as % of Cured Abrasive Layer | Number of Completed Flex Cycles Before Failure |
|---|---|---|
| Coated Abrasive 1 (Skybon ES-120 - No Bisphenol A | 0 wt % of Total Binder; 0 wt % of Cured Abrasive Layer | 3 |
| Coated Abrasive 2 (Skybon ES-955 - 23% Bisphenol-A) | 18.66 wt % of Total Binder; 3.26 wt % of Cured Abrasive Layer | 10 |
| Coated Abrasive 3 (50:50 Blend ES-120/ES-955) | 9.33 wt % of Total Binder; 1.63 wt % of Cured Abrasive Layer | 6 |

Coated Abrasive 1 did not contain any bisphenol A in the backbone of the cured polyester polymer binder. Both of the inventive sample coated abrasive films, Coated Abrasive 1 and Coated Abrasive 2, had greater flexural durability than Coated Abrasive 1. Coated Abrasive 2 had more than triple the number of completed flex cycles prior to failure compared to Coated Abrasive 1. Coated Abrasive 3 had double the number of completed flex cycles prior to failure compared to Coated Abrasive 1. An increase in the amount of bisphenol moiety (bisphenol-A) present in the backbone of the cured resin appears to have a directly proportional increase in the flexural durability of the cured abrasive layer and thus the overall durability of the abrasive film.

Example 3

Polishing of a Surface Coated with an Automotive Coating—Dynabrade System

A Dynabrade 1.25 inch diameter orbital sanding machine, model no. 57302, was used to compare the abrasion performance of the inventive abrasive films prepared as described above. The workpiece being polished was a metal plate coated with PPG #800 Clear Coat. The Dynabrade machine was set for grinding cycles of 3 seconds and used to make spot abrasions on the coated panel. The abrasive films were used to make as many spot abrasions as possible until the product life was exhausted. The results of the comparative testing are presented in the table below.

TABLE 4

Clear Coat Spot Abrasion/Defect Removal - Dynabrade Machine

| Parameter | Number of Spots Sanded |
|---|---|
| Control: 3M Trizact A5 466LA | 4 |
| Coated Abrasive Film 1 (Skybon ES-120 - No Bisphenol A) | 3 |
| Inventive - Coated Abrasive Film 2 (Skybon ES-955 - 23% Bisphenol-A) | 10 |
| Inventive - Abrasive Film 3 (50:50 Blend ES-120/ES-955) | 12 |

As shown in the table above, the control abrasive, which did not contain any co-polyester moieties, had a product life span of 4 spot abrasions.

As shown in the table above, Coated Abrasive 1, which contained a co-polyester resin, but did not contain any bisphenol moieties in the backbone of the co-polyester resin, had a product life span of only 3 spot abrasions.

Abrasive Film 2, which comprised a co-polyester resin having bisphenol-A in the backbone of the co-polyester (23 wt % of the copolyester resin, 3.26 wt % of the cured abrasive layer) had a much improved durability and abrasive performance over both the control abrasive and Abrasive Film 1. Abrasive Film 2 was able to make 10 spot abrasions before end of lifespan; more than two times as long as the Control and more than three times as long as Abrasive Film 1.

Abrasive Film 3, which comprised a blend of about an equal mixture of two copolyester resins, the first which had no bisphenol moieties in the back bone of the co-polyester resin and the second which had a bisphenol A moiety in the backbone of the co-polyester resin (23 wt % of the second copolyester resin, 1.63 wt % of the cured abrasive layer) had surprisingly superior abrasive performance over both the Control, Abrasive Film 1, and Abrasive Film 2. Abrasive Film 3 surprisingly was able to complete 12 spot abrasions before end of product life; more than two times as long as the Control and more than three times as long as Abrasive Film 1.

While each of the inventive samples (Abrasive Film 2 and Abrasive Film 3) showed at least one improved performance characteristic over the Control and Abrasive Film 1, the results of the above testing clearly indicate that Abrasive Film 3, having an about equal mixture of the non-bisphenol backbone and the bisphenol containing copolyester resins, counter intuitively produced superior results over the control sample and the product life was 300% of the control sample.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An abrasive product comprising:

abrasive particulate material; and a polymer binder comprising a co-polyester having a bisphenol moiety in the backbone of the co-polyester, wherein the bisphenol moiety is at least 3 wt % to not greater than 45 wt % of the co-polyester backbone, and wherein the abrasive particulate material is dispersed within the polymer binder.

2. The abrasive product of claim 1, wherein the co-polyester comprises a single co-polyester.

3. The abrasive product of claim 1, wherein the co-polyester comprises a mixture of co-polyesters.

4. The abrasive product of claim 1, wherein the co-polyester comprises at least a single co-polyester having a bisphenol moiety in its backbone.

5. The abrasive product of claim 1, wherein the co-polyester comprises a plurality of co-polyesters that each have a bisphenol moiety in their backbones.

6. The abrasive product of claim 1, further comprising a polymeric moiety that is cross-linked into the polymeric binder, wherein the polymeric moiety is selected from the group consisting of: bisphenol-A; an epoxy; a phenol formaldehyde; a blocked isocyanate; a urea formaldehyde; a novolac; a resole; a resorcinol-formaldehyde; a UV curable hybrid acrylic epoxy composition; and any combinations thereof.

7. The abrasive product of claim 6, wherein the polymeric moiety that is cross-linked into the polymeric binder comprises about 0.5 wt % to about 50 wt % of the total weight of the polymeric binder.

8. The abrasive product of claim 1, wherein the bisphenol moiety is one of the group consisting of Bisphenol-A (2,2-Bis(4-hydroxyphenyl)propane), Bisphenol AP (1,1-Bis(4-hydroxyphenyl)-1-phenyl-ethane), Bisphenol-AF (2,2-Bis(4-hydroxyphenyl)hexafluoropropane), Bisphenol-B (2,2-Bis(4-hydroxyphenyl)butane), Bisphenol-BP (Bis-(4-hydroxyphenyl)diphenylmethane), Bisphenol-C(2,2-Bis(3-methyl-4-hydroxyphenyl)propane), Bisphenol-E (1,1-Bis(4-hydroxyphenyl)ethane), Bisphenol-F (Bis(4-hydroxydiphenyl)methane), Bisphenol-G (2,2-Bis(4-hydroxy-3-isopropyl-phenyl)propane), Bisphenol-M (1,3-Bis(2-(4-hydroxyphenyl)-2-propyl)benzene), Bisphenol-S (Bis(4-hydroxyphenyl)sulfone), Bisphenol-P (1,4-Bis(2-(4-hydroxyphenyl)-2-propyl)benzene), Bisphenol-PH (5,5'-(1-Methylethyliden)-bis[1,1'-(bisphenyl)-2-ol[propane), Bisphenol-TMC (1,1-Bis(4-hydroyphenyl)-3,3,5-trimethyl-cyclohexane), Bisphenol-Z (1,1-Bis(4-hydroxyphenyl)-cyclohexane), and any combinations thereof.

9. The abrasive product of claim 1, wherein the bisphenol moiety is at least 5 wt % to not greater than 45 wt % of the co-polyester backbone.

10. The abrasive product of claim 1, further comprising a cross-linking agent.

11. The abrasive product of claim 10, further comprising a catalyst.

12. The abrasive product of claim 11, wherein the ratio of co-polyester to crosslinking agent ranges from about 45:1 to about 5:1.

13. The abrasive product of claim 10, wherein the crosslinking agent is an isocyanate or a methylated melamine.

14. The abrasive product of claim 11, wherein the catalyst is an amine neutralized mixture of sulfonic acids or a tetravalent diorganotin.

15. A coated abrasive product comprising:

a polymeric film backing; and a cured abrasive composition disposed on the backing, wherein the cured abrasive composition comprises a polymer binder; an abrasive particulate material, a crosslinking agent, and a catalyst, wherein the polymer binder comprises a co-polyester having a bisphenol moiety in the backbone of the co-polyester, wherein the ratio of abrasive particulate to polymeric binder ranges from about 1.5:1 to about 3.5:1, and wherein the ratio of polymer binder to crosslinking agent ranges from about 45:1 to about 15:1.

16. The coated abrasive product of claim 15, wherein the cured abrasive composition comprises: about 20 wt % to about 40 wt % polymer binder; about 85 wt % to about 50 wt % abrasive particulate material; about 0.4 wt % to about 2.0 wt % of a crosslinking agent; and about 0.01 wt % to about 0.04 wt % of a catalyst.

* * * * *